US011495132B2

(12) United States Patent
Borgyos et al.

(10) Patent No.: US 11,495,132 B2
(45) Date of Patent: Nov. 8, 2022

(54) UTM-ATC INTERFACE

(71) Applicant: GE Aviation Systems LLC, Grand Rapids, MI (US)

(72) Inventors: Szabolcs A. Borgyos, Grand Rapids, MI (US); Edward Andrew Lester, Somerville, MA (US)

(73) Assignee: GE Aviation Systems LLC, Grand Rapids, MI (US)

( * ) Notice: Subject to any disclaimer, the term of this patent is extended or adjusted under 35 U.S.C. 154(b) by 115 days.

(21) Appl. No.: 17/014,353

(22) Filed: Sep. 8, 2020

(65) Prior Publication Data

US 2022/0076582 A1 Mar. 10, 2022

(51) Int. Cl.
*G08G 5/00* (2006.01)
*G08G 5/04* (2006.01)

(52) U.S. Cl.
CPC ..... *G08G 5/0043* (2013.01); *G08G 5/006* (2013.01); *G08G 5/0026* (2013.01); *G08G 5/0069* (2013.01); *G08G 5/0082* (2013.01); *G08G 5/04* (2013.01)

(58) Field of Classification Search
CPC .. G08G 5/0043; G08G 5/0026; G08G 5/0082; G08G 5/04; G08G 5/0069; G08G 5/006
USPC ..... 701/120
See application file for complete search history.

(56) References Cited

U.S. PATENT DOCUMENTS 8,751,061 B2 * 6/2014 Coulmeau ..... G08G 5/0013 701/2
8,965,673 B2 2/2015 del Pozo de Poza
8,989,998 B2 * 3/2015 Le ..... G08G 5/0021 701/4
9,595,198 B2 3/2017 Limbaugh et al.
9,691,287 B1 * 6/2017 Shapiro ..... G06F 3/017
9,990,854 B1 6/2018 Elmasry et al.
10,059,444 B2 8/2018 Stefani
10,127,821 B2 * 11/2018 Balasubramanian ..... G08G 5/0021
10,332,405 B2 6/2019 Kopardekar
10,395,543 B2 8/2019 Chambers et al.
(Continued)

FOREIGN PATENT DOCUMENTS

WO 2009139937 A2 11/2009

OTHER PUBLICATIONS

Extended European Search Report for EP Application No. 21194507.6 dated Feb. 15, 2022 (7 pages).

*Primary Examiner* — Isaac G Smith
(74) *Attorney, Agent, or Firm* — Dinsmore & Shohl LLP

(57) ABSTRACT

An apparatus may receive first data, in a first data format, from one or more unmanned aircraft system service suppliers comprising first positions of one or more unmanned aircraft systems, receive second data, in a second data format, from one or more communications systems comprising second positions of one or more manned aircraft, transmit third data, in a third data format, comprising the first positions of the one or more unmanned aircraft systems and the second positions of the one or more manned aircraft, receive a first control signal comprising a control command associated with one or more of the unmanned aircraft systems or one or more of the manned aircraft, and transmit a second control signal comprising the control command to one or more of the unmanned aircraft system service suppliers or to one or more of the communications systems.

18 Claims, 5 Drawing Sheets

(56) References Cited

U.S. PATENT DOCUMENTS

| | | | | |
|---|---|---|---|---|
| 10,410,532 | B1 | 9/2019 | Myr | |
| 10,453,347 | B2 | 10/2019 | Winkler | |
| 2012/0257684 | A1* | 10/2012 | Vasek | G08G 5/0021 375/259 |
| 2015/0170524 | A1 | 6/2015 | Stefani et al. | |
| 2016/0244187 | A1* | 8/2016 | Byers | B64D 1/00 |
| 2017/0124734 | A1* | 5/2017 | Gowda | G08G 5/0021 |
| 2019/0012922 | A1* | 1/2019 | Selander | G08G 5/0026 |
| 2020/0043350 | A1 | 2/2020 | Cantrell et al. | |
| 2020/0258405 | A1 | 8/2020 | Fern et al. | |
| 2021/0043094 | A1* | 2/2021 | Heidger | G08G 5/0082 |

* cited by examiner

UTM-ATC INTERFACE

FIELD

The present disclosure relates to monitoring of aerial vehicles, and more specifically, to a UTM-ATC interface.

BACKGROUND

Air traffic control systems monitor and coordinate air traffic to ensure safety of aircraft and to expedite the flow of air traffic. Traditional air traffic control systems monitor manned aircraft, such as commercial airliners. Traditional air traffic control systems generally do not monitor smaller unmanned aircraft, such as drones. However, drones have lately become much more pervasive in society and are being used in a variety of commercial applications, as well as by hobbyists and others.

In order to monitor drone traffic, unmanned traffic management systems have been developed and deployed. These systems can manage drone traffic similarly to ways in which traditional air traffic control systems manage air traffic of larger aircraft. However, unmanned traffic management systems and traditional air traffic control systems are not currently integrated with each other. As such, there is a need for a common interface to both of these systems.

SUMMARY

In an embodiment, an apparatus includes one or more processors, one or more memory modules, and machine-readable instructions stored in the one or more memory modules. When executed by the one or more processors, the memory modules cause the apparatus to receive first data, in a first data format, from one or more unmanned aircraft system service suppliers comprising first positions of one or more unmanned aircraft systems, receive second data, in a second data format, from one or more communications systems comprising second positions of one or more manned aircraft, transmit third data, in a third data format, comprising the first positions of the one or more unmanned aircraft systems and the second positions of the one or more manned aircraft, receive a first control signal comprising a control command associated with one or more of the unmanned aircraft systems or one or more of the manned aircraft, and transmit a second control signal comprising the control command to one or more of the unmanned aircraft system service suppliers or to one or more of the communications systems.

In an embodiment, a system includes an ATC system and an ATC user interface. The ATC system sends data to and receives data from an unmanned traffic management network comprising a plurality of unmanned aircraft system service suppliers. The ATC system also sends data to and receives data from one or more communications systems. The ATC user interface sends data to and receives data from the ATC system. The ATC system receives first data, in a first data format, from the unmanned traffic management network including first positions of one or more unmanned aircraft systems. The ATC system receives second data, in a second data format, from the one or more communications systems including second positions of one or more manned aircraft. The ATC system transmits third data, in a third data format, including the first positions of the one or more unmanned aircraft systems and the second positions of the one or more manned aircraft. The ATC user interface displays the first positions of the one or more unmanned aircraft systems and the second positions of the one or more manned aircraft.

In an embodiment, a method includes receiving first positions of one or more unmanned aircraft systems in a first data format from one or more unmanned aircraft system service suppliers, receiving second positions of one or more manned aircraft in a second data format from one or more communications systems, transmitting the first positions of the one or more unmanned aircraft systems and the second positions of the one or more manned aircraft in a third data format to a user interface, receiving a first control signal comprising a control command associated with one of the one or more unmanned aircraft systems or the one or more manned aircraft from the user interface, and transmitting a second control signal comprising the control command associated with the one or more unmanned aircraft systems or the one or more manned aircraft to one or more of the unmanned aircraft system service suppliers or the communications systems.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

DETAILED DESCRIPTION

Figure 1:
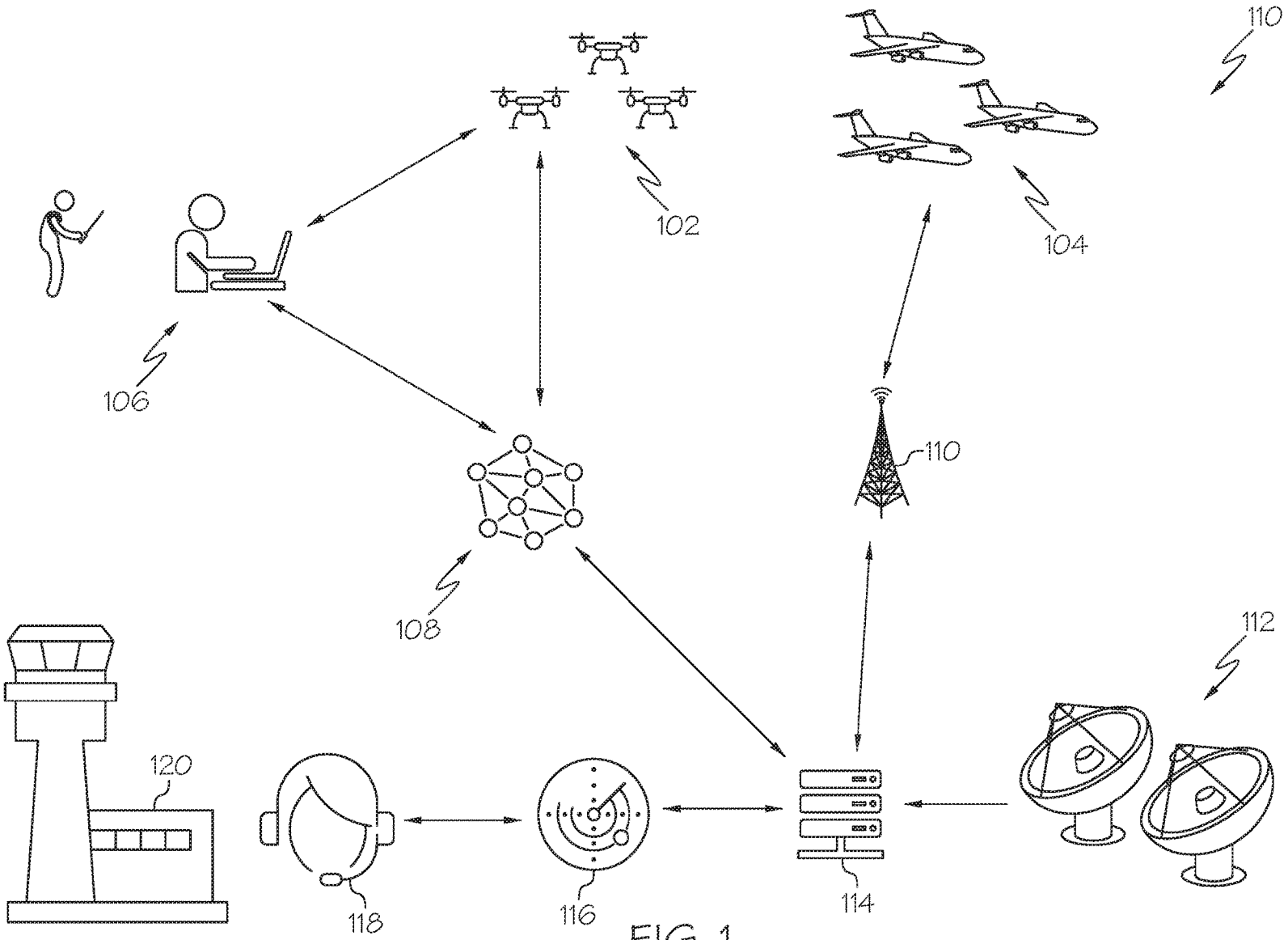
FIG. 1 schematically depicts an exemplary system for managing air traffic, according to one or more embodiments shown and described herein.

The present disclosure generally relates to a common interface for air traffic management (ATM) systems and unmanned traffic management (UTM) systems. ATM systems typically comprise a variety of air traffic control (ATC) systems, which manage manned aircraft. As disclosed herein, ATC systems may include ATC automation systems, surveillance systems, user interface, human controllers, and the like. ATC systems may monitor the position of aircraft and provide instructions to pilots to control the movement of aircraft to avoid collisions and facilitate expedient air traffic flow.

ATC systems typically manage aircraft at four levels. A first level of an ATC system is tower control or local airspace control, which manages airspace in the direct vicinity of an airport, and in particular, active runway surfaces. Airports typically have one or more control towers in which tower control operators work. Tower controllers typically use binoculars to visually monitor aircraft in the vicinity of the airport and communicate with pilots using radio. Tower controllers clear aircraft for takeoff or landing.

A second level of an ATC system is approach control or terminal control. Approach control typically comprises a radar system that monitors airspace within about 60 miles of an airport. An approach control facility is responsible for managing air traffic within a particular volume of airspace and hands off control to another facility as an aircraft is leaving that airspace. Approach controllers typically communicate with pilots via VHF radio.

A third level of an ATC system is en-route or area control. En-route control typically utilizes radar systems to monitor high altitude airspace for cruise portions of aircraft flight. En-route controllers may communicate with pilots either over VHF radio or using controller pilot datalink communications (CPDLC) to send structured messages to pilots. Pilots can receive CPDLC messages and respond in kind.

A fourth level of an ATC system is oceanic control to monitor aircraft when flying over an ocean. As an aircraft flies over an ocean, radar coverage is typically not available. Thus, oceanic control typically relies on timing and reports over high frequency radio or automatic position reporting systems to monitor aircraft. More recently, some oceanic control facilities use satellite data to monitor aircraft. Oceanic control facilities may communicate with pilots using CPDLC.

While the above-described ATC systems effectively manage manned aircraft, they are not designed to manage unmanned aircraft systems (UAS), such as drones. Thus, UTM systems have been developed to manage air traffic of UAS. A UTM system comprises one or more UAS service suppliers (USS). A USS may manage UAS traffic within a certain geographic area and/or for a certain set of clients. A USS may monitor UAS with either ground based radar tracking and/or by receiving telemetry directly from UAS, that identifies their position. In addition to tracking the position of UAS, a USS may communicate with UAS operators to provide instructions to guide UAS along certain routes to avoid collisions with other UAS and to otherwise manage airspace.

While a single USS may cover a certain geographic area, a plurality of USS may be part of a UTM network to manage air traffic over a larger geographic area. Different USS that are part of a UTM network may communicate with each other to jointly manage UAS air traffic (e.g., one USS may monitor a particular UAS and may hand off control to another USS as the USS is leaving its airspace). In addition, multiple USS may cover overlapping geographic areas, in which case they may communicate with each other to jointly ensure aircraft separation.

As discussed above, an ATC system may be used to manage manned aircraft and a UTM network may be used to manage unmanned aircraft. However, as more and more UAS are utilized in various commercial and non-commercial activities, it may be desirable for ATC systems to be able to monitor and control unmanned aircraft and/or provide digital authorization to unmanned aircraft that may wish to traverse controlled airspace. As such, one potential solution to this problem would be to modify ATC systems to be able to manage UAS in addition to manned aircraft. However, legacy ATC systems are difficult and expensive to modify. Another potential solution would be to build a new system that can manage both manned and unmanned system. However, this would also be difficult and expensive. Therefore, the present disclosure comprises a common interface for an ATC system and a UTM network.

FIG. 1 depicts an example system 100 for monitoring air traffic. In the example of FIG. 1, a plurality of UAS 102 (e.g., drones) and a plurality of manned aircraft 104 are flying in certain airspaces. The UAS 102 may be controlled by one or more UAS operators 106 and the manned aircraft 104 may be flown by one or more pilots (not shown in FIG. 1). Any number of UAS operators 106 may control any number of UAS 102. For example, one UAS operator 106 may control a single UAS 102, while another UAS operator 106 may control multiple UAS 102. In some examples, one or more of the UAS 102 may operate autonomously and may not be directly controlled by a UAS operator 106.

The UAS operators 106 may communicate with the UAS 102 that they are controlling via a command and control link (e.g., satellite, radio, cell phone). The UAS operators 106 may transmit commands to control the movement and operation of the UAS 102, and the UAS 102 may transmit data back to the UAS operators 106 (e.g., telemetry data or other types of data).

A UTM network 108 comprising one or more USS may manage air traffic control of the UAS 102. Each USS in the UTM network 108 may cover a certain geographic area and provide service to certain UAS operators 106. Because USS are currently less regulated than ATC systems for manned aircraft, UAS operators typically sign up for service with the USS of their choice. As such, multiple USS may provide service to clients in overlapping geographic areas.

Each USS may monitor one or more UAS 102 operated by one of the clients of the USS either using ground-based tracking (e.g., radar) or by receiving telemetry information from the UAS themselves. A USS may also receive a planned flight route for one or more UAS 102 from the associated UAS operators 106. A USS may send commands to the UAS operators 106 of the UAS 102 being monitored to ensure that UAS do not collide with each other and to provide other air traffic control features. In some examples, a USS may send commands directly to UAS 102 to modify their operation (e.g., changing their flight path). In addition, multiple USS in the UTM network 108 may communicate with each other to ensure that UAS being monitored by different USS do not collide with each other. USS may also receive supplemental data from other service provides (e.g., information regarding weather, terrain, and the like) and may provide this information to the UAS operators 106.

Referring still to FIG. 1, the plurality of manned aircraft 104 may communicate with an ATC system via communications systems 110. The manned aircraft 104 may send and receive communications via the communications systems 110. The communications systems 110 may comprise a plurality of different components including any of the components of an ATC system discussed above (e.g., tower control, approach control, en-route control, or oceanic control). In one example, the manned aircraft 104 send and receive CPDLC communications via the communications systems 110. In other examples, the manned aircraft 104 may send and receive other types of communications (e.g., voice) via the communications systems 110.

Referring still to FIG. 1, the system 100 may also comprise surveillance systems 112. The surveillance systems 112 may comprise a variety of systems to monitor positions of the manned aircraft 104, such as primary or secondary radar, telemetry, or automatic dependent surveillance-broadcast (ADS-B) systems. In some examples, the surveillance systems 112 may also monitor positions of the UAS 102.

The UTM network 108, the communications systems 110, and the surveillance systems 112 may communicate with an ATC system 114. The ATC system 114 may receive communications from the UTM network 108 comprising information about the UAS 102 (e.g., positions, flight paths, requests for airspace). The ATC system 114 may also receive communications from the communications systems 110 comprising information about the manned aircraft 104 (e.g., positions and flight paths). The ATC system 114 may also receive communications from the surveillance systems 112 comprising positions of the manned aircraft 104 and/or the UAS 102. The ATC system 114 may also transmit to the UTM network 108 and the communications systems 110, as explained further below.

The system 100 may also comprise an ATC user interface 116. The ATC user interface 116 may transmit information to and receive data from the ATC system 114. Specifically, the ATC system 114 may transmit information to the ATC user interface 116 regarding positions and flight paths of UAS 102 and manned aircraft 104. The ATC user interface 116 may transmit control commands to the ATC system 114 to be sent to the UAS operators 106 via the UTM network 108 or to the manned aircraft 104 via the communications systems 110. The ATC user interface 116 may comprise a display (e.g., a screen) to display information received from the ATC system 114 and one or more input devices (e.g., a mouse and keyboard) to receive control commands from an operator. The ATC user interface 116 may be operated by an air traffic controller 118 working in a control tower 120 or other air traffic control operations center. In some examples, the ATC user interface 116 may be a traditional air traffic control display used by air traffic controllers.

The UTM network 108 and the communications systems 110 may utilize different data formats to communicate with the UAS 102 and the manned aircraft 104, respectively (e.g., CPDLC data may be used to communicate with the manned aircraft 104, while this type of data is not typically used to communicate with UAS). Thus, the data received by the ATC system 114 from the UTM network 108 may be in a different format than the type of data received by the ATC system 114 from the communications systems 110. However, the data received by the ATC system 114 from the UTM network 108 and the communications systems 110 may comprise similar information (e.g., positions and flight paths of aircraft and requests for airspace). Accordingly, the ATC system 114 may convert the data received from each of the UTM network 108, the communications systems 110, and the surveillance systems 112 into a common format to display on the ATC user interface 116. In addition, the ATC system 114 may receive control signals from the ATC user interface 116 in a single format and may convert the control signals into the appropriate format to be sent to either the UTM network 108 or the communications systems 110. The operation of the ATC system 114 is discussed in further detail below.

Figure 2:
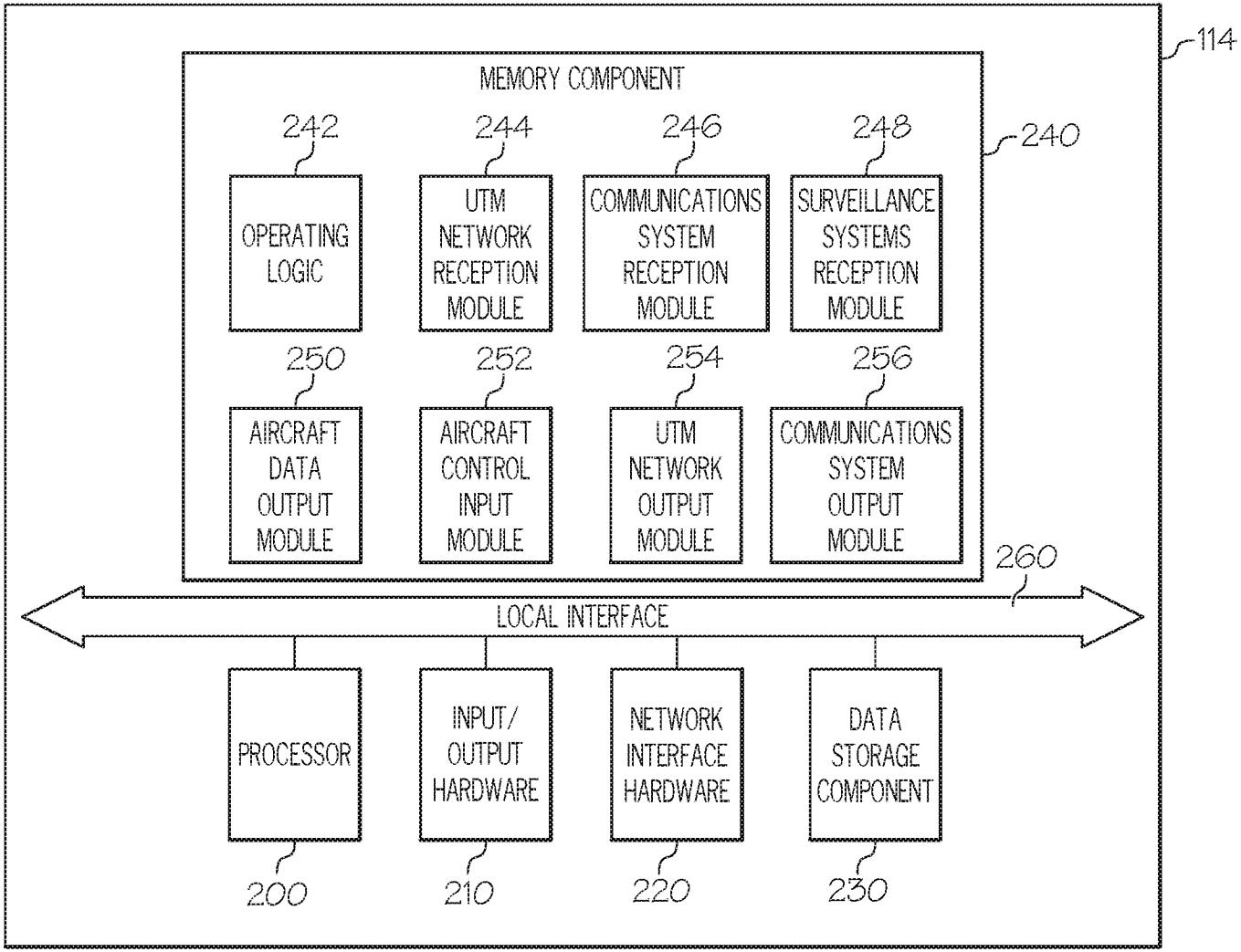
FIG. 2 schematically depicts an example ATC system, according to one or more embodiments shown and described herein.

Now referring to FIG. 2, the components of the ATC system 114 are schematically depicted. In the illustrated example, the ATC system 114 is a server computing device. However, in other examples, the ATC system 114 may be any type of computing device (e.g., mobile computing device, personal computer, etc.). Additionally, while the ATC system 114 is depicted in FIG. 2 as a single piece of hardware, this is also merely an example. More specifically, the ATC system 114 may represent a plurality of computers, servers, databases, etc. In some examples, the ATC system 114 may be configured as a general-purpose computer with the requisite hardware, software, and/or firmware. In other examples, the ATC system 114 may be configured as a collection of cooperating computing devices or even as a special purpose computer designed specifically for performing the functionality described herein.

As illustrated in FIG. 2, the ATC system 114 may include a processor 200, input/output hardware 210, network interface hardware 220, a data storage component 230, and a non-transitory memory component 240. The memory component 240 may be configured as volatile and/or nonvolatile computer readable medium and, as such, may include random access memory (including SRAM, DRAM, and/or other types of random access memory), flash memory, registers, compact discs (CD), digital versatile discs (DVD), and/or other types of storage components. Additionally, the memory component 240 may be configured to store operating logic 242, a UTM network reception module 244, a communications system reception module 246, a surveillance systems reception module 248, an aircraft data output module 250, an aircraft control input module 252, a UTM network output module 254, and a communications system output module 256 (each of which may be embodied as a computer program, firmware, or hardware, as an example). A network interface 260 is also included in FIG. 2 and may be implemented as a bus or other interface to facilitate communication among the components of the ATC system 114.

The processor 200 may include any processing component configured to receive and execute instructions (such as from the data storage component 230 and/or the memory component 240). The input/output hardware 210 may include a monitor, keyboard, mouse, printer, camera, microphone, speaker, touch-screen, and/or other device for receiving from, and sending data to the ATC user interface 116. The network interface hardware 220 may include any wired or wireless networking hardware, such as a modem, LAN port, wireless fidelity (Wi-Fi) card, WiMax card, mobile communications hardware, and/or other hardware for communicating with the UTM network 108, the communications systems 110, the surveillance systems 112, and other networks and/or devices.

The data storage component 230 may store information received from the UTM network 108, the communications system 110, the surveillance systems 112, and/or the ATC user interface 116. The data received from these devices or systems is discussed in further detail below.

Included in the memory component 240 are operating logic 242, the UTM network reception module 244, the communications system reception module 246, the surveillance systems reception module 248, the aircraft data output module 250, the aircraft control input module 252, the UTM network output module 254, and the communications system output module 256. The operating logic 242 may include an operating system and/or other software for managing components of the ATC system 114.

The UTM network reception module 244 may receive data from the UTM network 108 and may convert the format of the received data to a data format recognized by the ATC user interface 116 (e.g., the format of the data received from the communications system 110 by the communications system reception module 246). Specifically, the UTM network reception module 244 may receive data from one or more USS within the UTM network 108, which are managing one or more UAS 102. The received data may comprise positions of one or more UAS 102 and intent trajectories (e.g., flight routes) of one or more UAS 102. In addition, in some examples, the received data may comprise a request for a UAS 102 to use certain airspace. In other examples, the received data may include other information about the UAS 102 and/or other requests relating to one or more UAS 102.

Each of the UAS 102 may be managed by a different USS in the UTM network 108. As such, when the UTM network reception module 244 receives data from a particular USS in the UTM network 108 associated with a particular UAS 102, the UTM network reception module 244 may record an ID of the USS and an associated ID of the UAS 102 for which data is received in the data storage component 230. If, at a later time, the UTM network reception module 244 receives data associated with the same UAS 102 from a different USS, the ID of the USS associated with the UAS 102 may be updated in the data storage component 230. This allows the ATC system 114 to keep track of which USS in the UTM network 108 are associated with which UAS 102. This may allow the UTM network reception module 244 to send commands to the appropriate USS to be relayed to a UAS operator 106 of a particular UAS 102.

The communications system reception module 246 may receive data from the communications system 110 and may convert the format of the received data to a data format recognized by the ATC user interface 116. The communications system reception module 246 may receive data from a variety of different types of communications systems 110 (e.g., tower control, approach control, en-route control, or oceanic control). The received data may comprise information about one or more manned aircraft 104 such as positions and intent trajectories (e.g., flight routes). The received data may also comprise requests from a pilot of manned aircraft 104 (e.g., a request for airspace or a request to takeoff or land). The received data may comprise CPDLC data or data in any other format.

When the communications system reception module 246 receives data from a particular communications system 110 associated with a particular manned aircraft 104, the communications system reception module 246 may record an ID of the communications system 110 along with an ID of the manned aircraft 104 for which data is received in the data storage component 230. If, at a later time, the communications system reception module 246 receives data associated with the same manned aircraft 104 from a different communications system 110, the ID of the communications system 110 associated with the manned aircraft 104 may be updated in the data storage component 230. This allows the ATC system 114 to keep track of which communications systems 110 are associated with which manned aircraft 104. This may allow the communications system reception module 246 to send commands to the appropriate communications system 110 to be relayed to a pilot of a particular manned aircraft 104.

The surveillance systems reception module 248 may receive data from the surveillance systems 112 and may convert the format of the received data to a data format recognized by the ATC user interface 116. The surveillance systems 112 may directly measure positions of UAS 102 and/or manned aircraft 104 (e.g., using radar). This data may be transmitted to the ATC system 114 and received by the surveillance systems reception module 248.

The aircraft data output module 250 may output data to the ATC user interface 116 to cause the ATC user interface 116 to display aircraft information. Specifically, the aircraft data output module 250 may output data comprising positions and intent trajectories of one or more UAS 102 and/or manned aircraft 104 based on the data received from the UTM network 108, the communications systems 110, and/or the surveillance systems 112. While the data received from the UTM network 108, the communications systems 110, and the surveillance systems 112 may all comprise different data formats, the ATC system 114 outputs data to the ATC user interface 116 in a single data format representing positions and intent trajectories of UAS 102 and/or manned aircraft 104. For example, the ATC system 114 may output data to the ATC user interface 116 in CPDLC text-based format and/or in a visual or graphical format. As such, in this example, the ATC user interface 116 may be a user interface for a traditional air traffic control system, which may minimize the new hardware needed for the system 100.

Figure 5:
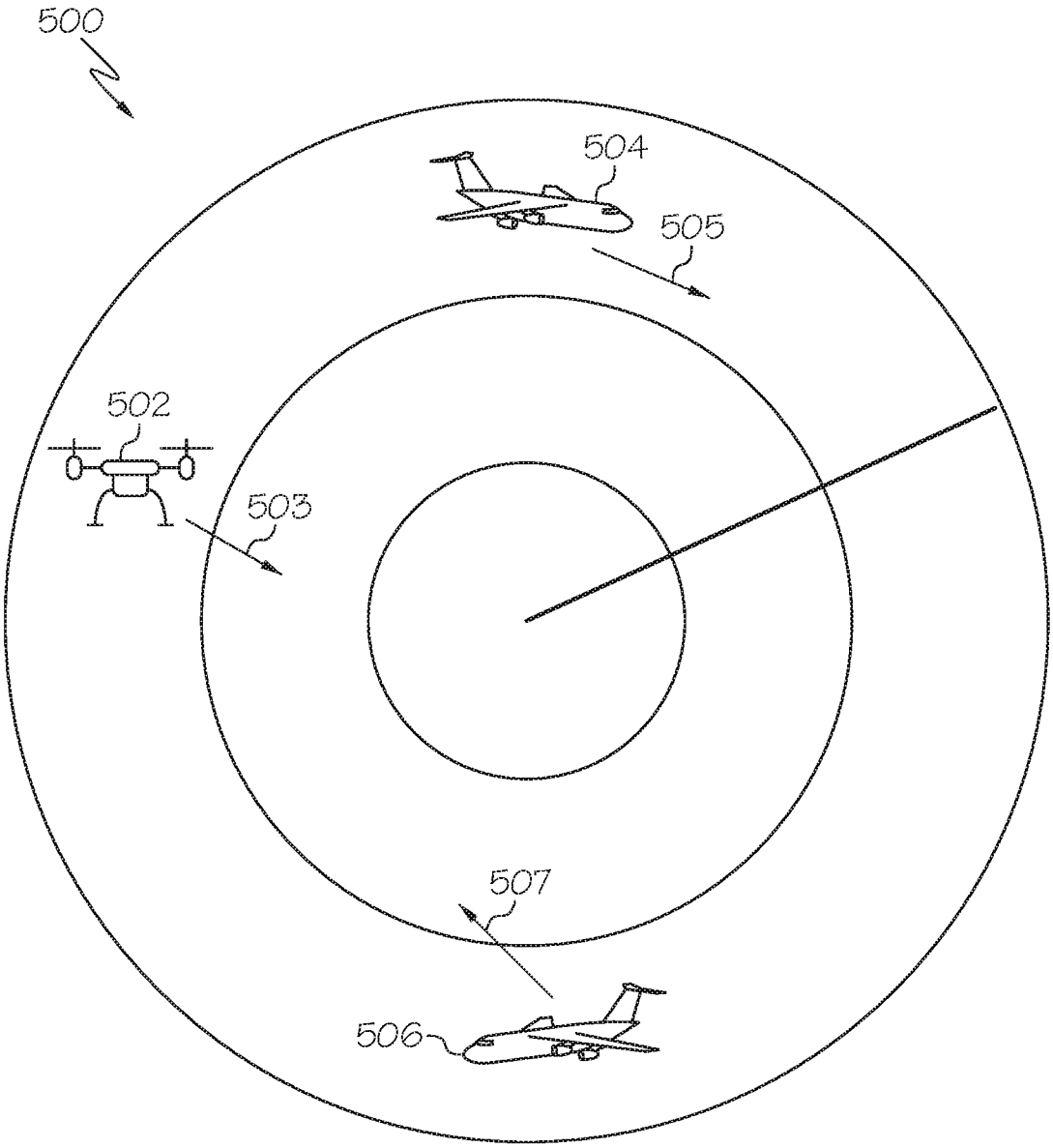
FIG. 5 depicts an example ATC user interface, according to one or more embodiments shown and described.

After receiving data from the ATC system 114, the ATC user interface 116 may display the positions and intent trajectories of the UAS 102 and/or manned aircraft 104 included in the received data. FIG. 5 shows an example display 500 of the ATC user interface 116. In the example of FIG. 5, the display 500 shows positions of a UAS 502 and manned aircraft 504 and 506. The UAS 502 has an intent trajectory 503 and the manned aircraft 504, 506 have intent trajectories 505, 507, respectively. In the example of FIG. 5, the intent trajectories 503, 505, 507 are instantaneous trajectory vectors. However, in other examples, intent trajectories may comprise an intended flight plan (e.g., a series of waypoints that may include altitudes and/or times), an intended flight 4D volume, or other ways of describing intended path As the positions of the UAS 502 and the manned aircraft 504, 506 change, their position may be updated on the display 500. Further, as the intent trajectories 503, 505, 507 change, the intent trajectories on the display 500 may be updated as well.

Referring back to FIG. 2, the aircraft control input module 252 receives control signals from the ATC user interface 116. As explained above, the air traffic controller 118 may use one or more input devices to input control signals into the ATC user interface 116. For example, the air traffic controller 118 may wish to change the intent trajectory of the UAS 502 or one of the manned aircraft 504, 506 (e.g., to avoid a collision), in the example of FIG. 5. In traditional air traffic control systems, air traffic controllers only interact with manned aircraft. However, the system 100 allows air traffic controllers to control both manned aircraft and unmanned aircraft. Thus, in the example of FIG. 5, the air traffic controller 118 may input a control command into the ATC user interface 116 to change an intent trajectory of the UAS 502 or one of the manned aircraft 504, 506. In one example, the air traffic controller 118 may use a mouse to drag the intent trajectories 503, 505, 507 to new positions. In other examples, other types of input may be used by the air traffic controller 118 to input control commands (e.g., new intent trajectories). In some examples, the air traffic controller 118 may utilize the ATC user interface 116 to input other control commands, such as setting the parameters of an airspace exclusion zone.

An airspace exclusion zone may be a volume of airspace where unmanned aircraft are not allowed to fly, a volume of airspace where manned aircraft are not allowed to fly, or a volume of airspace where neither manned nor unmanned aircraft are allowed to fly. Alternatively, the ATC user interface 116 may be used to restrict UAS operation in a certain area (e.g., limit the elevations where UAS are allowed to fly) or to designate a volume of airspace solely for the use of UAS. In some examples, the ATC user interface 116 may be used to authorize or deny requests from UAS 102 or manned aircraft 104 (e.g., requests to use airspace). In other examples, the ATC user interface 116 may be used to assign an airspace volume to protect an intent trajectory and/or protect an area of airspace. In other examples, the ATC user interface 116 may be used to issue tactical separation commands (e.g., turn left/right, climb/descend, change speed, etc.). All of these controls signals may be transmitted from the ATC user interface 116 to the ATC system 114 and may be received by the aircraft control input module 252.

In some examples, other entities, such as law enforcement officers or other authorized individuals, may be allowed to establish an airspace exclusion zone. In these examples, authorized individuals may transmit a request to establish an airspace exclusion zone to the UTM network 108. The request may be sent from a computing device, a smartphone, or other devices. The request may include the geometry of the volume of airspace to be included in the airspace exclusion zone as well as other details (e.g., which types of aircraft are to be excluded, the time period of the exclusion, etc.).

The request may be received by USS in the UTM network 108, which may forward the request to the ATC system 114. The request may be received by the UTM network reception module 244. The aircraft data output module 250 may then output a signal to cause the ATC user interface 116 to display a message to the air traffic controller 118 requesting the establishment of the aircraft exclusion zone. If the air traffic controller 118 authorizes the aircraft exclusion zone, the ATC user interface 116 transmits a control signal that is received by the aircraft control input module 252 to establish the requested aircraft exclusion zone.

The UTM network output module 254 may transmit control signals to the UTM network 108 to issue control commands to one or more of the UAS 102. The UTM network output module 254 may convert control signals received by the aircraft control input module 252 into an appropriate data format used by the UTM network 108. The control signals may then be sent to the UTM network 108 in the appropriate data format. As explained above, the ATC system 114 may maintain a record in the data storage component 230 of the specific USS that is managing a particular UAS 102. Thus, in order to issue a control signal associated with a particular UAS 102 (e.g., an updated intent trajectory), the UTM network output module 254 may transmit an appropriate control signal to the specific USS managing that UAS 102. In some examples, the UTM network output module 254 may output a control signal to multiple USS or to the entire UTM network 108 (e.g., establishing an airspace exclusion zone). After a USS of the UTM network 108 receives a control signal from the UTM network output module 254, it may transmit the control signal to the UAS operator 106 of the appropriate UAS 102, or, in some examples, directly to the UAS 102.

The communications system output module 256 may transmit control signals to the communications systems 110 to issue a control commands to one or more of the manned aircraft 104. The communications system output module 256 may send these control signals in the appropriate data format used by the communications systems 110 (e.g., CPDLC commands). As explained above, the ATC system 114 may maintain a record in the data storage component 230 of the specific communications system 110 that is managing a particular manned aircraft 104. Thus, in order to issue a control signal associated with a particular manned aircraft 104 (e.g., an updated intent trajectory), the communications system output module 256 may transmit an appropriate control signal to the specific communications system 110 managing that manned aircraft 104. In some examples, the communications system output module 256 may transmit a control signal to multiple communications systems 110 (e.g., establishing an airspace exclusion zone). After the appropriate communications system 110 receives a control signal from the communications system output module 256, it may transmit the control signal to the pilot of the appropriate manned aircraft 104.

It should be understood that the components illustrated in FIG. 2 are merely illustrative and are not intended to limit the scope of this disclosure. More specifically, while the components in FIG. 2 are illustrated as residing within the ATC system 114, this is a non-limiting example. In some embodiments, one or more of the components may reside external to the ATC system 114.

Figure 3:
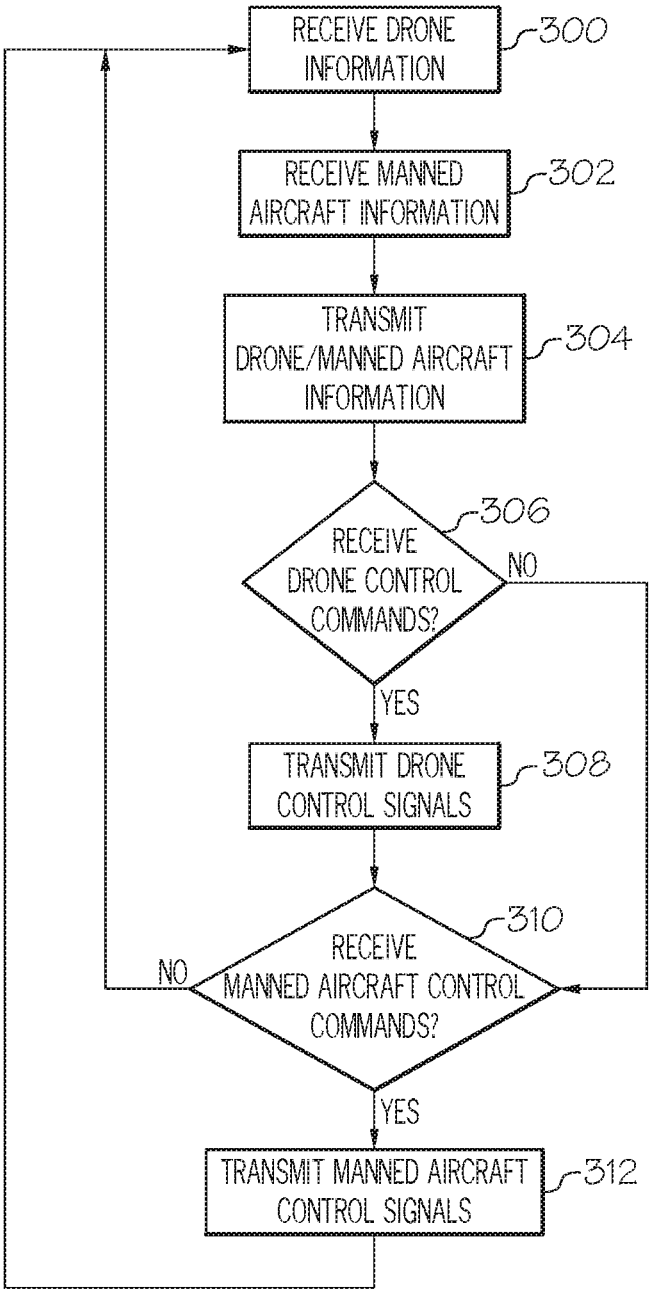
FIG. 3 depicts a flow chart of an illustrative method of managing air traffic, according to one or more embodiments shown and described herein.

As mentioned above, the various components described with respect to FIG. 2 may be used to carry out one or more processes and/or provide functionality for managing air traffic. An illustrative example of the various processes is described with respect to FIG. 3. Although the steps associated with the blocks of FIG. 3 will be described as being separate tasks, in other embodiments, the blocks may be combined or omitted. Further, while the steps associated with the blocks of FIG. 3 will be described as being performed in a particular order, in other embodiments, the steps may be performed in a different order Referring now to FIG. 3, a flow chart is shown for monitoring air traffic, according to one or more embodiments shown and described herein. At step 300, the UTM network reception module 244 receives first data, in a first data format, from one or more UAS service suppliers comprising first positions of one or more UAS. The one or more UAS may comprise one or more UAS 102 and the one or more UAS service suppliers may be part of the UTM network 108. The first data may include positions of the UAS 102, intent trajectories of the UAS 102, requests for authorization to use a volume of airspace, and the like. The first data format may comprise a UTM data format.

At step 302, the communications system reception module 246 receives second data, in a second data format, from one or more communications systems. The one or more communications systems may comprise the communications systems 110. The second data may include positions of the manned aircraft 104, intent trajectories of the manned aircraft 104, requests for authorization to use a volume of airspace, and the like. The second data format may comprise CPDLC data.

At step 304, the aircraft data output module 250 transmits third data, in a third data format, comprising the first positions of the one or more UAS 102 and the second positions of the one or more manned aircraft 104 to the ATC user interface 116. The third data may comprise the received data regarding the UAS 102 and the manned aircraft 104 (e.g., positions and/or intent trajectories of the UAS 102 and/or the manned aircraft 104). The third data format may comprise CPDLC data or another format understood by the ATC user interface 116. The ATC user interface 116 may then display the third data regarding the UAS 102 and the manned aircraft 104 such that it may be viewed by the air traffic controller 118. Specifically, the transmission of the third data may cause the first positions and the second positions to be displayed to a user. In some examples, the ATC system 114 may receive fourth data from the surveillance systems 112 comprising the first positions of the one or more UAS 102 or the second positions of the one or more manned aircraft 104.

The air traffic controller 118 may then input control commands into the ATC user interface 116, which may then be transmitted to the ATC system 114. As such, the aircraft control input module 252 may receive a first control signal comprising a control command associated with one or more of the UAS 102 or one or more of the manned aircraft 104. The ATC system 114 may then transmit a second control signal comprising the control command to the UTM network 108 or the communications systems 110, as explained in further detail below. In one example, the control command may comprise granting authorization for one of the UAS 102 of one of the manned aircraft to use a volume of airspace. In another example, the control command may comprise a request of one of the UAS 102 or one of the manned aircraft 104 to change an intent trajectory. In another example, the control command may comprise parameters to establish an airspace exclusion zone.

At step 306, the UTM network output module 254 determines whether the aircraft control input module 252 received any control commands associated with one or more of the UAS 102. If control commands were received for one of more of the UAS 102 (yes at step 306), then, at step 308, the UTM network output module 254 transmits the received control signals to the UTM network 108. If control commands were not received for one or more of the UAS 102 (no at step 306), then control passes to step 310. When the second control signal is transmitted to the UTM network 108, the third data format matches the first data format.

At step 310, the communications system output module 256 determines whether the aircraft control input module 252 received any control commands associated with one or more of the manned aircraft 104. If control commands were received for one or more of the manned aircraft 104 (yes at step 310), then, at step 312, the communications system output module 256 transmits the received control signals to the communications systems 110. If control commands were not received for one or more of the manned aircraft 104 (no at step 310), then control returns to step 300. Furthermore, after the communications system output module 256 transmits the received control signals to the communications systems 110, control returns to step 300. When the second control signal is transmitted to the communications systems 110, the third data format matches the second data format.

Figure 4:
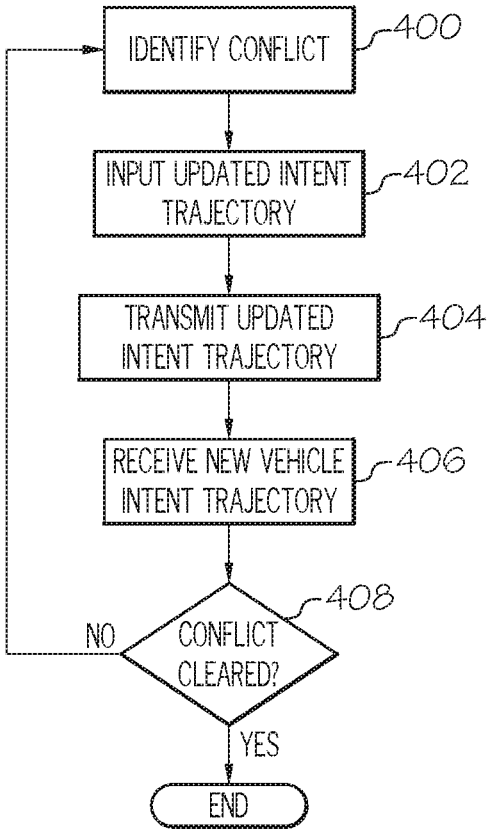
FIG. 4 depicts a flow chart of another illustrative method of managing air traffic, according to one or more embodiments shown and described herein.

Referring now to FIG. 4, another flow chart is shown for monitoring air traffic, according to one or more embodiments shown and described herein. At step 400, the air traffic controller 118 identifies an air traffic conflict (e.g., two aircraft within too close proximity of each other).

At step 402, the air traffic controller 118 uses the ATC user interface 116 to input an updated intent trajectory to one or more of the aircraft (e.g., UAS 102 and/or manned aircraft 104) involved in the conflict. The ATC user interface 116 may then transmit the updated intent trajectory to the ATC system 114.

At step 404, the ATC system 114 transmits a request to use the updated intent trajectory to the UTM network 108 and/or the communications system 110. Specifically, if the updated intent trajectory relates to a UAS 102, the request is transmitted to the UTM network 108. If the updated intent trajectory relates to a manned aircraft 104, the request is transmitted to the communications systems 110. The UTM network 108 or the communications systems 110 may then relay the updated intent to the appropriate UAS operator 106 of a UAS 102 or to the pilot of a manned aircraft 104. After the UAS operator 106 or pilot of the manned aircraft 104 receives the request to update their intent trajectory, they may accept the request and update their intent trajectory, deny the request and maintain their current intent trajectory, or modify their intent trajectory in a different manner than the request. In either case, the new intent trajectory may be transmitted to the UTM network 108 or communications systems 110 and relayed to the ATC system 114.

At step 406, the ATC system 114 receives the new intent trajectory of the UAS 102 or manned aircraft 104 associated with the updated intent trajectory input by the air traffic controller 118.

At step 408, the air traffic controller 118 determines whether the new intent trajectory clears the air traffic conflict. If the new intent trajectory does clear the conflict (yes at step 408), then the method of FIG. 4 ends. If the new intent trajectory does not clear the conflict (no at step 408), then control returns to step 400 and the air traffic controller 118 may repeat the steps of FIG. 4 to clear the conflict.

It should now be understood that the devices, systems, and methods described herein allow for air traffic control of both UAS and manned aircraft using a single user interface. An ATC system may receive data regarding UAS from a UTM network and may receive data about manned aircraft from communications systems. The ATC system may also receive data regarding UAS and/or manned aircraft from one or more surveillance systems.

After receiving data regarding UAS and/or manned aircraft, this data may be transmitted to an ATC user interface to display information about UAS and manned aircraft, such as their positions and intent trajectories. An air traffic controller may utilize the ATC user interface to input control commands relating to either the UAS or the manned aircraft. These control commands may then be transmitted to the ATC system, which may relay control commands associated with UAS to the UTM network and may relay control commands associated with manned aircraft to the communications system.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

Further aspects of the invention are provided by the subject matter of the following clauses.

An apparatus comprising one or more processors; one or more memory modules; and machine-readable instructions stored in the one or more memory modules that, when executed by the one or more processors, cause the apparatus to: receive first data, in a first data format, from one or more unmanned aircraft system service suppliers comprising first positions of one or more unmanned aircraft systems; receive second data, in a second data format, from one or more communications systems comprising second positions of one or more manned aircraft; transmit third data, in a third data format, comprising the first positions of the one or more unmanned aircraft systems and the second positions of the one or more manned aircraft; receive a first control signal comprising a control command associated with one or more of the unmanned aircraft systems or one or more of the manned aircraft; and transmit a second control signal comprising the control command to one or more of the unmanned aircraft system service suppliers or to one or more of the communications systems.

The apparatus of any preceding clause, wherein the second data format comprises controller pilot data link communications.

The apparatus of any preceding clause, wherein the machine-readable instructions, when executed, cause the apparatus to convert the first data from the first data format to a controller pilot datalink communications format.

The apparatus of any preceding clause, wherein: the first data further comprises first intent trajectories of one or more of the unmanned aircraft systems; the second data further comprises second intent trajectories of one or more of the manned aircraft; and the third data further comprises the first intent trajectories of one or more of the unmanned aircraft systems and the second intent trajectories of the one or more of the manned aircraft, The apparatus of any preceding clause, wherein at least one of the first data and the second data comprises a request from one of the unmanned aircraft systems or one of the manned aircraft for authorization use a volume of airspace.

The apparatus of any preceding clause, wherein the control command comprises granting authorization for one of the unmanned aircraft systems or one of the manned aircraft to use the volume of airspace.

The apparatus of any preceding clause, wherein the control command comprises a request for one or the unmanned aircraft systems or one of the manned aircraft to change an intent trajectory.

The apparatus of any preceding clause, wherein the control command comprises parameters to establish an airspace exclusion zone.

The apparatus of any preceding clause, wherein: when the second control signal is transmitted to one or more of the unmanned aircraft system service suppliers, the third data format matches the first data format; and when the second control signal is transmitted to one or more of the communications systems, the third data format matches the second data format.

The apparatus of any preceding clause, wherein transmission of the third data causes the first positions and the second positions to be displayed to a user.

The apparatus of any preceding clause, wherein transmission of the third data causes the first intent trajectories and the second intent trajectories to be displayed to a user.

The apparatus of any preceding clause, wherein the machine-readable instructions, when executed by the one or more processors, cause the apparatus to receive fourth data from one or more surveillance systems comprising the first positions of the one or more unmanned aircraft systems or the second positions of the one or more manned aircraft.

A system comprising: an unmanned traffic management network comprising an ATC system to send data to and receive data from an unmanned traffic management network comprising a plurality of unmanned aircraft system service suppliers and to send data to and receive data from one or more communications systems; and an ATC user interface to send data to and receive data from the ATC system, wherein: the ATC system receives first data, in a first data format, from the unmanned traffic management network comprising first positions of one or more unmanned aircraft systems; the ATC system receives second data, in a second data format, from the one or more communications systems comprising second positions of one or more manned aircraft; the ATC system transmits third data, in a third data format, comprising the first positions of the one or more unmanned aircraft systems and the second positions of the one or more manned aircraft; and the ATC user interface displays the first positions of the one or more unmanned aircraft systems and the second positions of the one or more manned aircraft.

The system of any preceding clause, wherein the ATC system receives data associated with the one or more unmanned aircraft systems or the one or more manned aircraft from one or more surveillance systems.

The system of any preceding clause, wherein: the first data further comprises first intent trajectories of the one or more unmanned aircraft systems; the second data further comprises second intent trajectories of the one or more manned aircraft; the third data further comprises the first intent trajectories of the one or more unmanned aircraft systems and the second intent trajectories of the one or more manned aircraft; and the ATC user interface displays the first intent trajectories of the one or more unmanned aircraft systems and the second intent trajectories of the one or more manned aircraft.

The system of any preceding clause, wherein: the ATC system transmits requests for authorization to use airspace received from the unmanned traffic management network and the communications systems to the ATC user interface; the ATC user interface displays requests to use airspace, receives input to either authorize or deny the requests, and transmits the authorization or denial of the use of airspace to the ATC system; and the ATC system transmits the authorization or denial of the use of airspace to the unmanned traffic management network and the communications systems.

The system of any preceding clause, wherein: the ATC user interface allows a user to input requests to change an intent trajectory of one or more of the unmanned aircraft systems or the manned aircraft; the ATC user interface transmits requests to change intent trajectories to the ATC system; and the ATC system transmits requests to change intent trajectories to the unmanned traffic management network and the communications systems.

A method comprising receiving first positions of one or more unmanned aircraft systems in a first data format from one or more unmanned aircraft system service suppliers; receiving second positions of one or more manned aircraft in a second data format from one or more communications systems; transmitting the first positions of the one or more unmanned aircraft systems and the second positions of the one or more manned aircraft in a third data format to a user interface; receiving a first control signal comprising a control command associated with one of the one or more unmanned aircraft systems or the one or more manned aircraft from the user interface; transmitting a second control signal comprising the control command associated with the one or more unmanned aircraft systems or the one or more manned aircraft to one or more of the unmanned aircraft system service suppliers or the communications systems.

The method of any preceding clause, further comprising: receiving first intent trajectories of the one or more unmanned aircraft systems from the one or more unmanned aircraft system service suppliers; and receiving second intent trajectories of the one or more manned aircraft from the one or more communications systems, wherein the control command comprises a request to change one of the first intent trajectories or the second intent trajectories.

The method of any preceding clause, further comprising: receiving a request for authorization to use airspace from one or more of the unmanned aircraft system service suppliers or the communications systems; transmitting the request for authorization to use the airspace to the user interface; receiving authorization to use the airspace from the user interface; and transmitting the authorization to use the airspace to the one or more of the unmanned aircraft system service suppliers or the communications systems.

What is claimed is:

1. An apparatus comprising a controller programmed to:

receive first data, in a first data format, from one or more unmanned aircraft system service suppliers comprising first positions of one or more unmanned aircraft systems;

receive second data, in a second data format, from one or more communications systems comprising second positions of one or more manned aircraft;

transmit third data, in a third data format, comprising the first positions of the one or more unmanned aircraft systems and the second positions of the one or more manned aircraft;

receive a first control signal comprising a first control command associated with a first unmanned aircraft system among the one or more unmanned aircraft systems;

receive a second control signal comprising a second control command associated with a first manned aircraft among the one or more manned aircraft;

determine a first unmanned aircraft system service supplier, among the one or more unmanned aircraft system service suppliers, that is associated with the first unmanned aircraft system;

determine a first communications system, among the one or more communications systems, that is associated with the first manned aircraft;

convert the first control signal into a third control signal in the first data format;

convert the second control signal into a fourth control signal in the second data format;

transmit the third control signal to the first unmanned aircraft system service supplier; and transmit the fourth control signal to the first communications system.

2. The apparatus of claim 1, wherein the second data format comprises controller pilot datalink communications.

3. The apparatus of claim 1, wherein:

the first data further comprises first intent trajectories of one or more of the unmanned aircraft systems;

the second data further comprises second intent trajectories of one or more of the manned aircraft; and the third data further comprises the first intent trajectories of one or more of the unmanned aircraft systems and the second intent trajectories of the one or more of the manned aircraft.

4. The apparatus of claim 1, wherein at least one of the first data and the second data comprises a request from one of the unmanned aircraft systems or one of the manned aircraft for authorization to use a volume of airspace.

5. The apparatus of claim 4, wherein at least one of the first control command and the second control command comprises granting authorization for one of the unmanned aircraft systems or one of the manned aircraft to use the volume of airspace.

6. The apparatus of claim 1, wherein the first control command or the second control command comprises a request for one or the unmanned aircraft systems or one of the manned aircraft to change an intent trajectory.

7. The apparatus of claim 1, wherein at least one of the first control command and the second control command comprises parameters to establish an airspace exclusion zone.

8. The apparatus of claim 1, wherein transmission of the third data causes the first positions of the one or more unmanned aircraft systems and the second positions of the one or more manned aircraft to be displayed to a user.

9. The apparatus of claim 3, wherein transmission of the third data causes the first intent trajectories of the one or more unmanned aircraft systems and the second intent trajectories of the one or more manned aircraft to be displayed to a user.

10. The apparatus of claim 1, wherein the controller is further programmed to cause the apparatus to receive fourth data from one or more surveillance systems comprising the first positions of the one or more unmanned aircraft systems or the second positions of the one or more manned aircraft.

11. A system comprising:

an ATC system to send data to and receive data from an unmanned traffic management network comprising a plurality of unmanned aircraft system service suppliers and to send data to and receive data from one or more communications systems; and an ATC user interface to send data to and receive data from the ATC system, wherein:

the ATC system receives first data, in a first data format, from the unmanned traffic management network comprising first positions of one or more unmanned aircraft systems;

the ATC system receives second data, in a second data format, from the one or more communications systems comprising second positions of one or more manned aircraft;

the ATC system transmits third data, in a third data format, comprising the first positions of the one or more unmanned aircraft systems and the second positions of the one or more manned aircraft;

the ATC system receives a first control signal comprising a first control command associated with a first unmanned aircraft system among the one or more unmanned aircraft systems;

the ATC system receives a second control signal comprising a second control command associated with a first manned aircraft among the one or more manned aircraft;

the ATC system determines a first unmanned aircraft system service supplier, among the one or more unmanned aircraft system service suppliers, that is associated with the first unmanned aircraft system;

the ATC system determines a first communications system, among the one or more communications systems, that is associated with the first manned aircraft;

the ATC system converts the first control signal into a third control signal in the first data format;

the ATC system converts the second control signal into a fourth control signal in the second data format;

the ATC system transmits the third control signal to the first unmanned aircraft system service supplier;

the ATC system transmits the fourth control signal to the first communications system; and the ATC user interface displays the first positions of the one or more unmanned aircraft systems and the second positions of the one or more manned aircraft.

12. The system of claim 11, wherein the ATC system receives data associated with the one or more unmanned aircraft systems or the one or more manned aircraft from one or more surveillance systems.

13. The system of claim 11, wherein:

the first data further comprises first intent trajectories of the one or more unmanned aircraft systems;

the second data further comprises second intent trajectories of the one or more manned aircraft;

the third data further comprises the first intent trajectories of the one or more unmanned aircraft systems and the second intent trajectories of the one or more manned aircraft; and the ATC user interface displays the first intent trajectories of the one or more unmanned aircraft systems and the second intent trajectories of the one or more manned aircraft.

14. The system of claim 11, wherein:

the ATC system transmits requests for authorization to use airspace received from the unmanned traffic management network and the communications systems to the ATC user interface;

the ATC user interface displays requests to use airspace, receives input to either authorize or deny the requests, and transmits the authorization or denial of the use of airspace to the ATC system; and the ATC system transmits the authorization or denial of the use of airspace to the unmanned traffic management network and the communications systems.

15. The system of claim 14, wherein:

the ATC user interface allows a user to input requests to change an intent trajectory of one or more of the unmanned aircraft systems or the manned aircraft;

the ATC user interface transmits requests to change intent trajectories to the ATC system; and the ATC system transmits requests to change intent trajectories to the unmanned traffic management network and the communications systems.

16. A method comprising:

receiving first positions of one or more unmanned aircraft systems in a first data format from one or more unmanned aircraft system service suppliers;

receiving second positions of one or more manned aircraft in a second data format from one or more communications systems;

transmitting the first positions of the one or more unmanned aircraft systems and the second positions of the one or more manned aircraft in a third data format to a user interface;

receiving a first control signal comprising a first control command associated with a first unmanned aircraft system among the one or more unmanned aircraft systems;

receiving a second control signal comprising a second control command associated with a first manned aircraft among the one or more manned aircraft;

determining a first unmanned aircraft system service supplier, among the one or more unmanned aircraft system service suppliers, that is associated with the first unmanned aircraft system;

determining a first communications system, among the one or more communications systems, that is associated with the first manned aircraft;

converting the first control signal into a third control signal in the first data format;

converting the second control signal into a fourth control signal in the second data format;

transmitting the third control signal to the first unmanned aircraft system service supplier; and transmitting the fourth control signal to the first communications system.

17. The method of claim 16, further comprising:

receiving first intent trajectories of the one or more unmanned aircraft systems from the one or more unmanned aircraft system service suppliers; and receiving second intent trajectories of the one or more manned aircraft from the one or more communications systems, wherein at least one of the first control command and the second control command comprises a request to change one of the first intent trajectories or the second intent trajectories.

18. The method of claim 16, further comprising:

receiving a request for authorization to use airspace from one or more of the unmanned aircraft system service suppliers or the communications systems;

transmitting the request for authorization to use the airspace to the user interface;

receiving authorization to use the airspace from the user interface; and transmitting the authorization to use the airspace to the one or more of the unmanned aircraft system service suppliers or the communications systems.

* * * * *